US008186412B2

(12) United States Patent
Lin

(10) Patent No.: US 8,186,412 B2
(45) Date of Patent: May 29, 2012

(54) WINDOW BLIND

(76) Inventor: Shih-Ming Lin, Chiayi Hsien (TW)

( * ) Notice: Subject to any disclaimer, the term of this patent is extended or adjusted under 35 U.S.C. 154(b) by 134 days.

(21) Appl. No.: 12/801,993

(22) Filed: Jul. 7, 2010

(65) Prior Publication Data

US 2011/0253324 A1 Oct. 20, 2011

(51) Int. Cl.
*A47H 5/00* (2006.01)

(52) U.S. Cl. ..... 160/84.01; 160/89; 160/108

(58) Field of Classification Search ..... 160/108, 160/89, 84.01; 24/336, 531, 458, 563, 561, 24/30.5 S See application file for complete search history.

(56) References Cited

U.S. PATENT DOCUMENTS 183,812 A * 10/1876 Mayo ..... 24/562
2,938,252 A * 5/1960 Scheemaeker ..... 24/67.9
3,636,597 A * 1/1972 Barnickel ..... 24/198
4,414,717 A * 11/1983 Payne ..... 24/30.5 R
4,734,543 A * 3/1988 Nolf ..... 174/88 R
2010/0269985 A1* 10/2010 Hanley et al. ..... 160/84.04
2011/0247761 A1* 10/2011 Lin ..... 160/84.02
2011/0247762 A1* 10/2011 Lin ..... 160/84.02
2011/0247765 A1* 10/2011 Lin ..... 160/133
2011/0253324 A1* 10/2011 Lin ..... 160/309

* cited by examiner

*Primary Examiner* — Blair M. Johnson
(74) *Attorney, Agent, or Firm* — Davidson Berquist Jackson & Gowdey LLP

(57) ABSTRACT

A window blind window blind includes a winding roller rollably mounted a window to lift or lower a roll-up piece, a blind curtain disposed forwardly of the roll-up piece and having elongate loop members, and a plurality of modular clip devices. Each loop member defines a lengthwise hole, and has an anchoring head portion having an access slot, marginal and gripped regions disposed at two sides of the lengthwise hole. Each clip device includes a grip body and a holding tongue. The grip body has loop-side and roll-up piece-side gaps to form a middle gripping finger portion, and internal and external gripping finger portions. The internal gripping finger portion and the holding tongue are placed in the lengthwise hole by virtue of inserting through the access slot to abut against the gripped and marginal regions, respectively. The roller-up piece is snugly engageable in the roll-up piece-side gap.

5 Claims, 7 Drawing Sheets

WINDOW BLIND

BACKGROUND OF THE INVENTION

1. Field of the Invention

This invention relates to a window blind, more particularly to a roman-type window blind with modular clip devices for connecting a blind curtain to a roll-up piece.

2. Description of the Related Art

Referring to FIGS. 1 to 3, a conventional roman-type window blind is shown to include a headrail 11 mounted at an upper edge of a window to rollably support a winding roller 111, a roll-up piece 112 connected to and wound around the winding roller 111 to lift or lower, a weight rod 113 mounted on a lower end portion of the roll-up piece 112, a blind curtain 12 having a major surface 121 confronting and spaced apart from the roll-up piece 112 and formed with a plurality of elongate loop members 122, and a plurality of clips 13 disposed to connect the roll-up piece 112 to a respective one of the loop members 122. Each clip 13 has two pairs of gripping fingers 131 bent by a metal wire to form an inner gap 132 to clamp the respective loop member 122 and an outer gap 134 to clamp the roll-up piece 112.

During rolling-up operation of the winding roller 111, the roll-up piece 112 is moved with the weight rod 113 of the roll-up piece 112 through the clips 13. Hence, the gripping fingers 131 clamping the respective loop member 122 may be undesiredly twisted, thereby breaking loose the clamping engagement between the roll-up piece 112 and the gripping finger 131 and resulting in malfunction of the window blind.

SUMMARY OF THE INVENTION

An object of the present invention is to provide a window blind which has a modular clip device for reliably connecting between a blind curtain and a roll-up piece.

According to this invention, the window blind includes a winding roller rollably mounted at an upper edge of a window, a roll-up piece having an upper end portion connected to the winding roller, and disposed to be wound around the winding roller to lift or lower a lower end portion thereof, a blind curtain having a top end portion spaced apart from the upper end portion, and a back major surface confronting the roll-up piece, a plurality of elongate loop members attached to the back major surface, and a plurality of modular clip devices. Each loop member defines a lengthwise hole, and has an anchoring head portion having an access slot in spatial communication with the lengthwise hole, a marginal region interposed between a left edge and the access slot, and a gripped region extending from the access slot towards a right edge. Each clip device includes a grip body and a holding tongue. The grip body has a major gripping wall having loop-side and roll-up piece-side gaps that respectively extend through a leading side towards a trailing side to form a middle gripping finger portion, and internal and external gripping finger portions which flank the middle gripping finger portion. The loop-side and roll-up piece-side gaps are dimensioned such that, when the internal gripping finger portion which is placed in the lengthwise hole by virtue of inserting therein the leading side thereof through the access slot, is shifted, in cooperation with the middle gripping finger portion, the internal gripping finger portion is in a linearly-displaceable snug engagement with the gripped region, and such that the roller-up piece is linearly displaceable and snugly engageable in the roll-up piece-side gap. The holding tongue extends from the trailing side of the internal gripping finger portion and which is brought to abut against the marginal region so as to ensure immobility of the internal gripping finger portion in the lengthwise hole.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
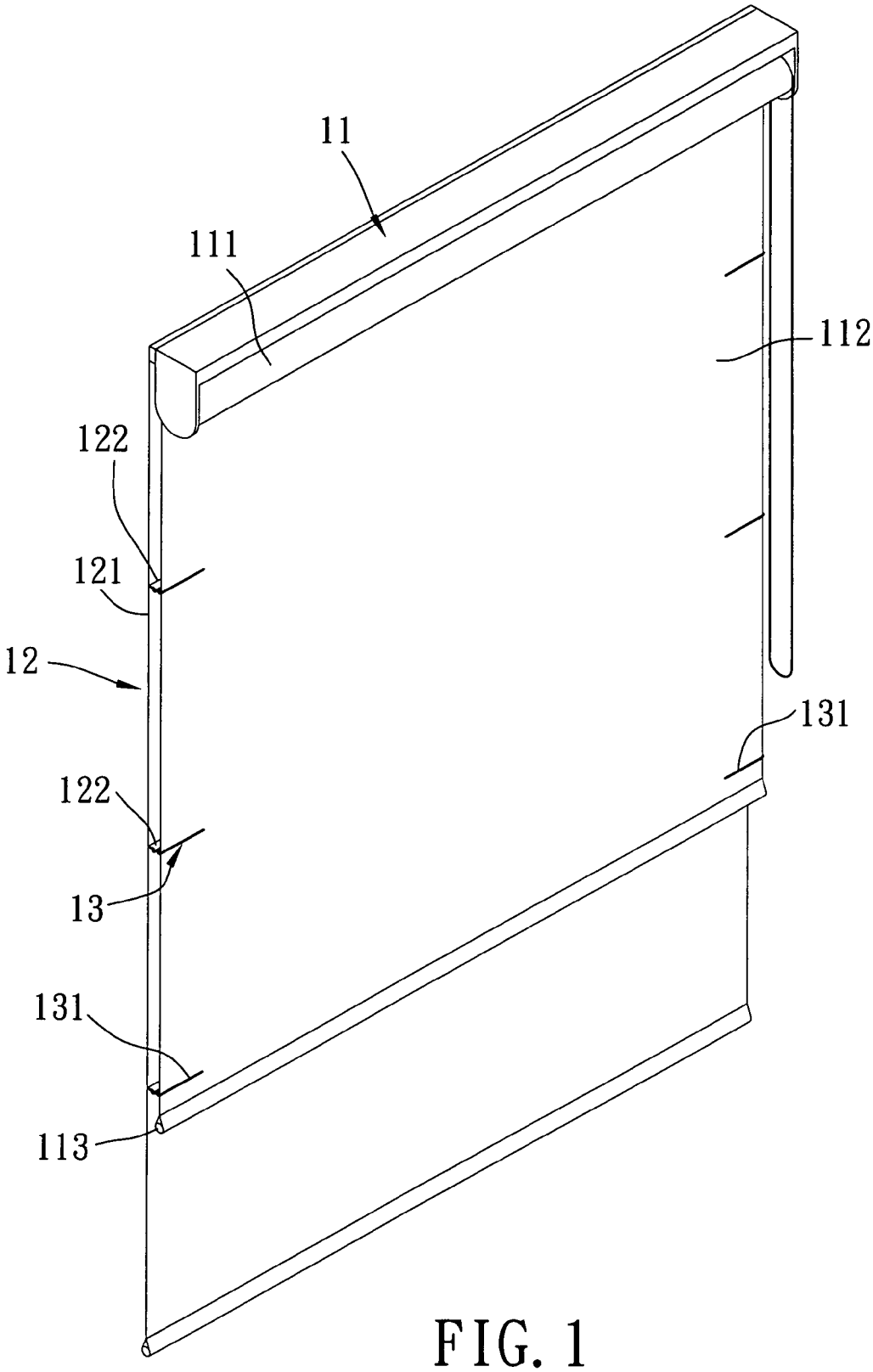
FIG. 1 PRIOR ART
FIG. 1 is a perspective view of a conventional window blind.
Figure 2:
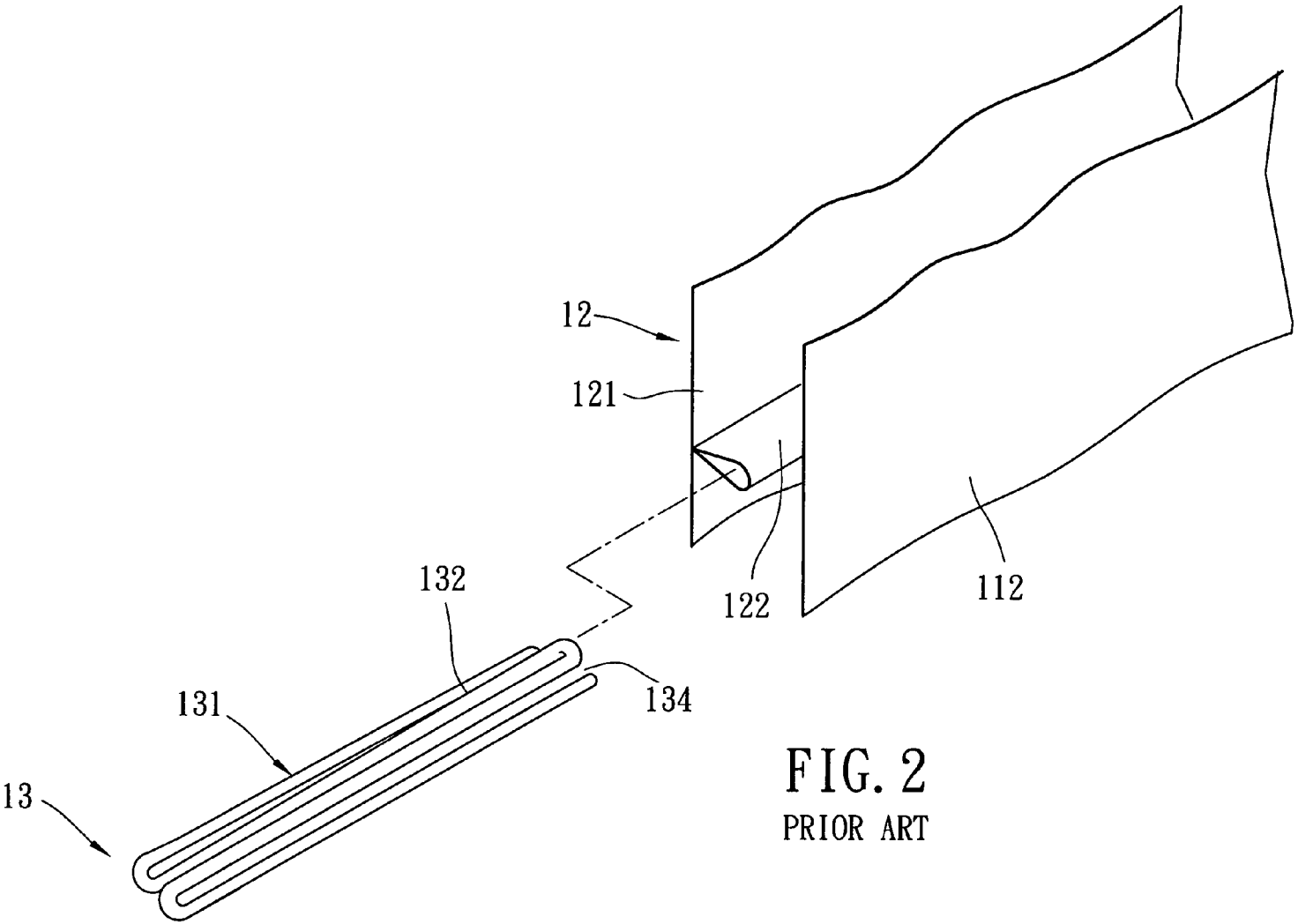
FIG. 2 PRIOR ART
FIG. 2 is a fragmentary exploded perspective view of the conventional window blind.
Figure 3:
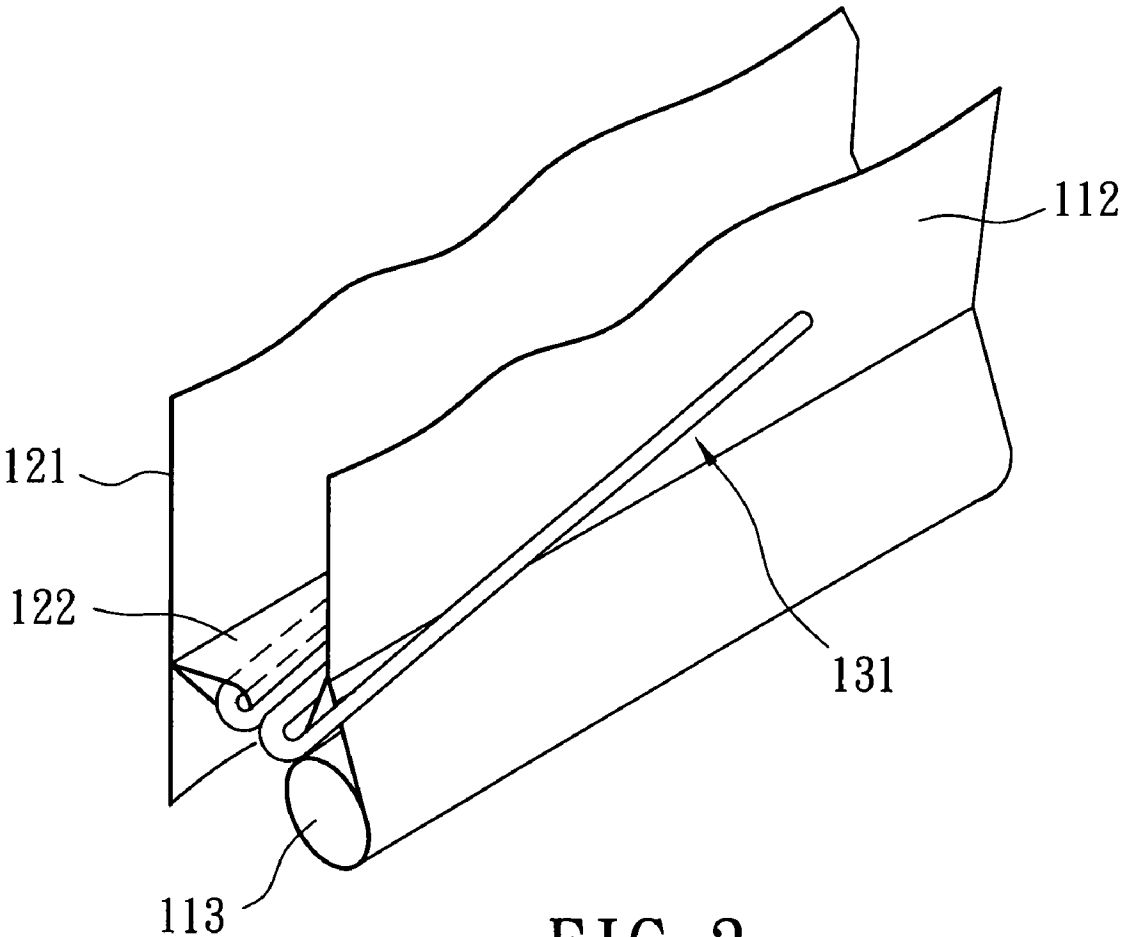
FIG. 3 PRIOR ART
FIG. 3 is a fragmentary perspective view of the conventional window blind.
Figure 4:
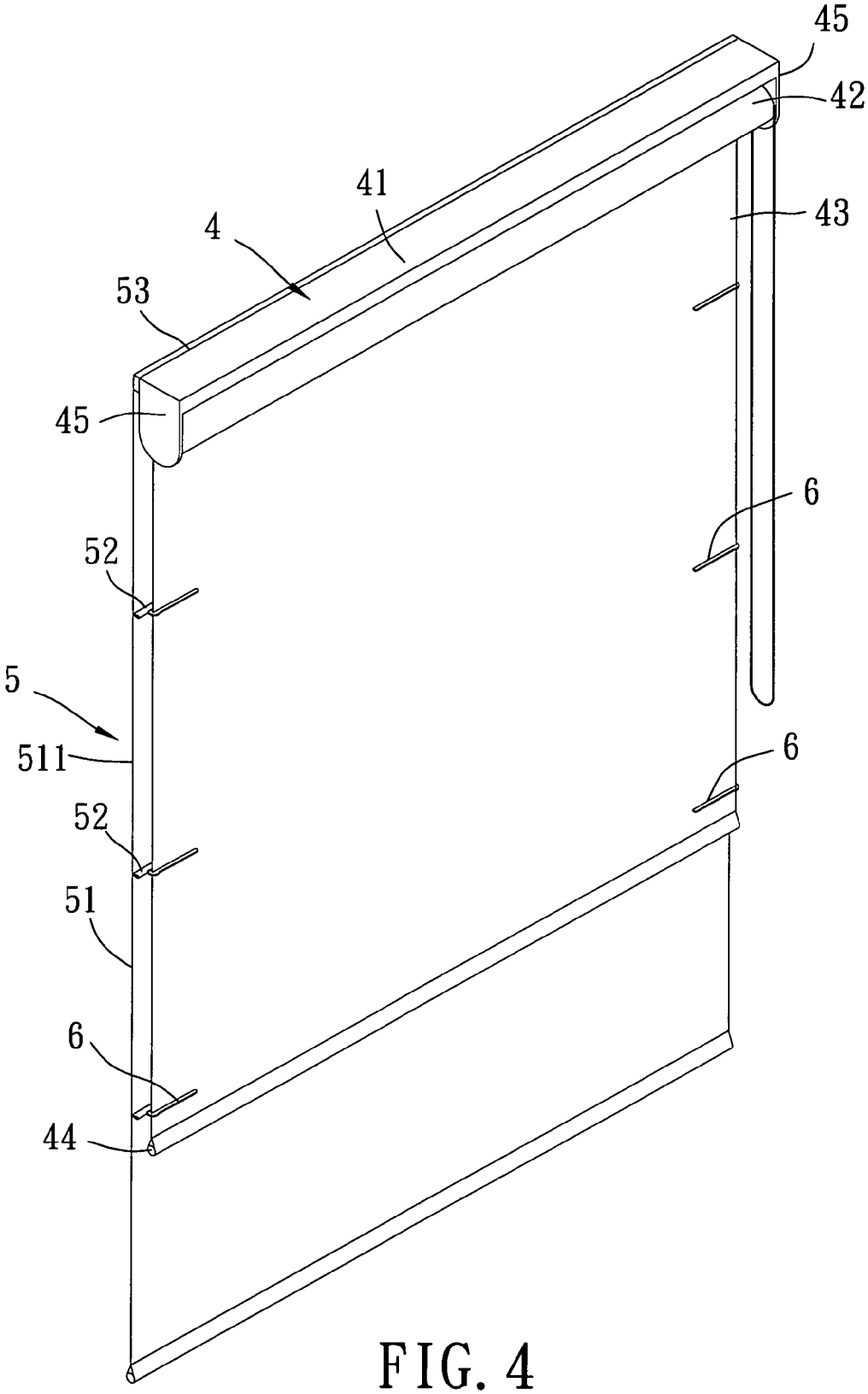
FIG. 4 is a perspective view of the preferred embodiment of a window blind according to this invention.
Figure 5:
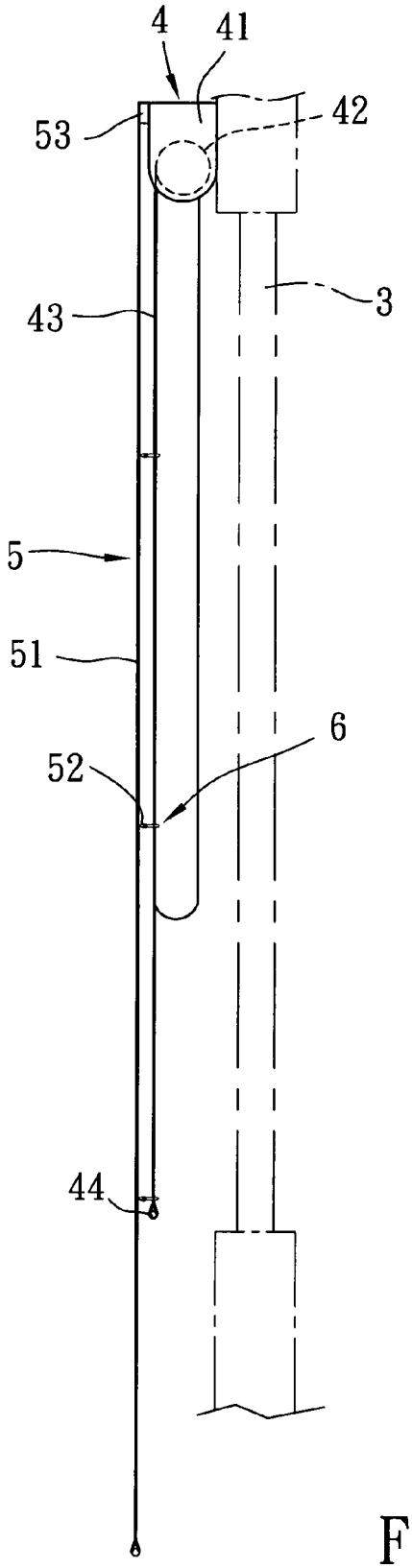
FIG. 5 is a side view of the preferred embodiment.
Figure 6:
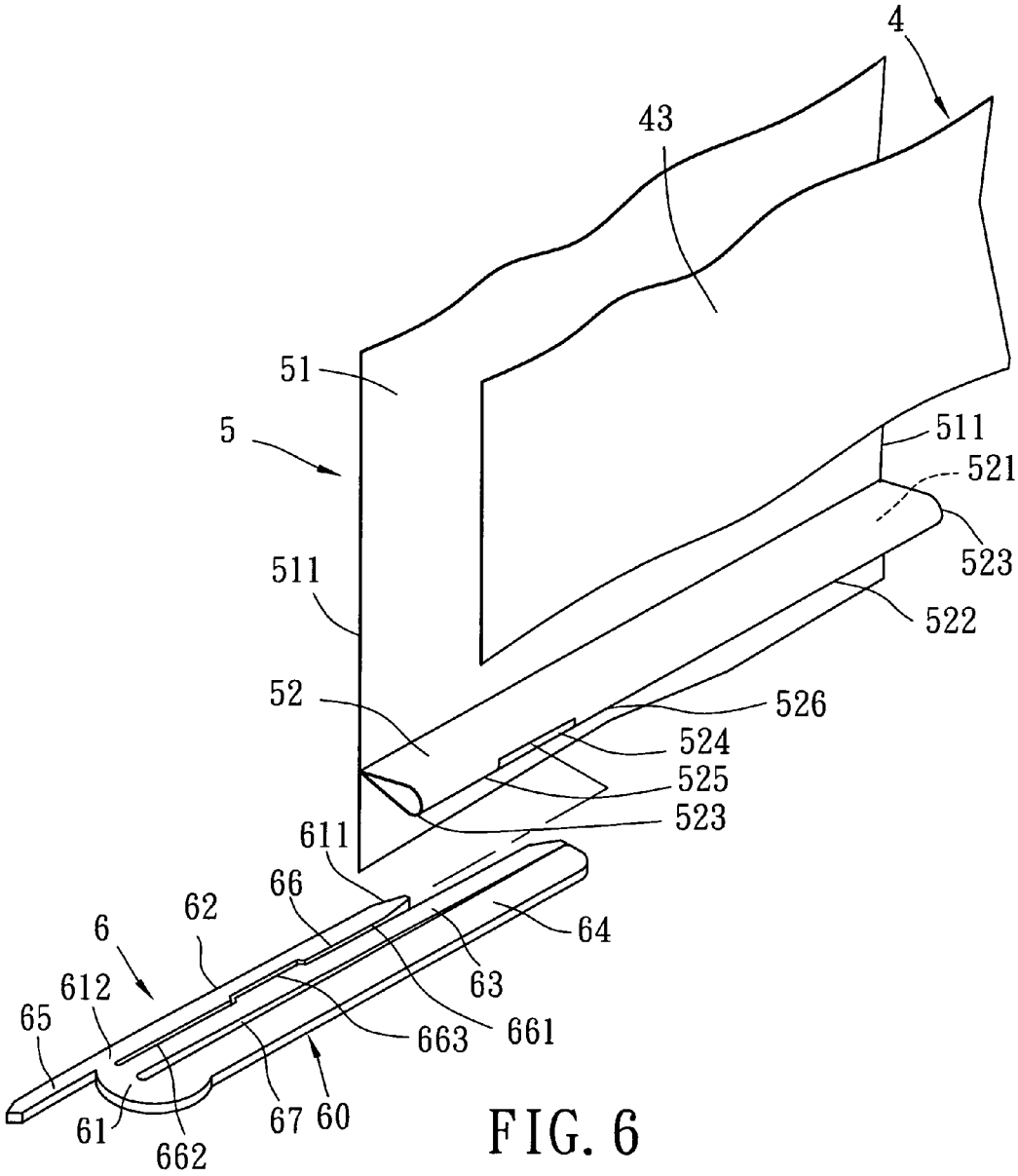
FIG. 6 is a fragmentary exploded perspective view of the preferred embodiment.
Figure 7:
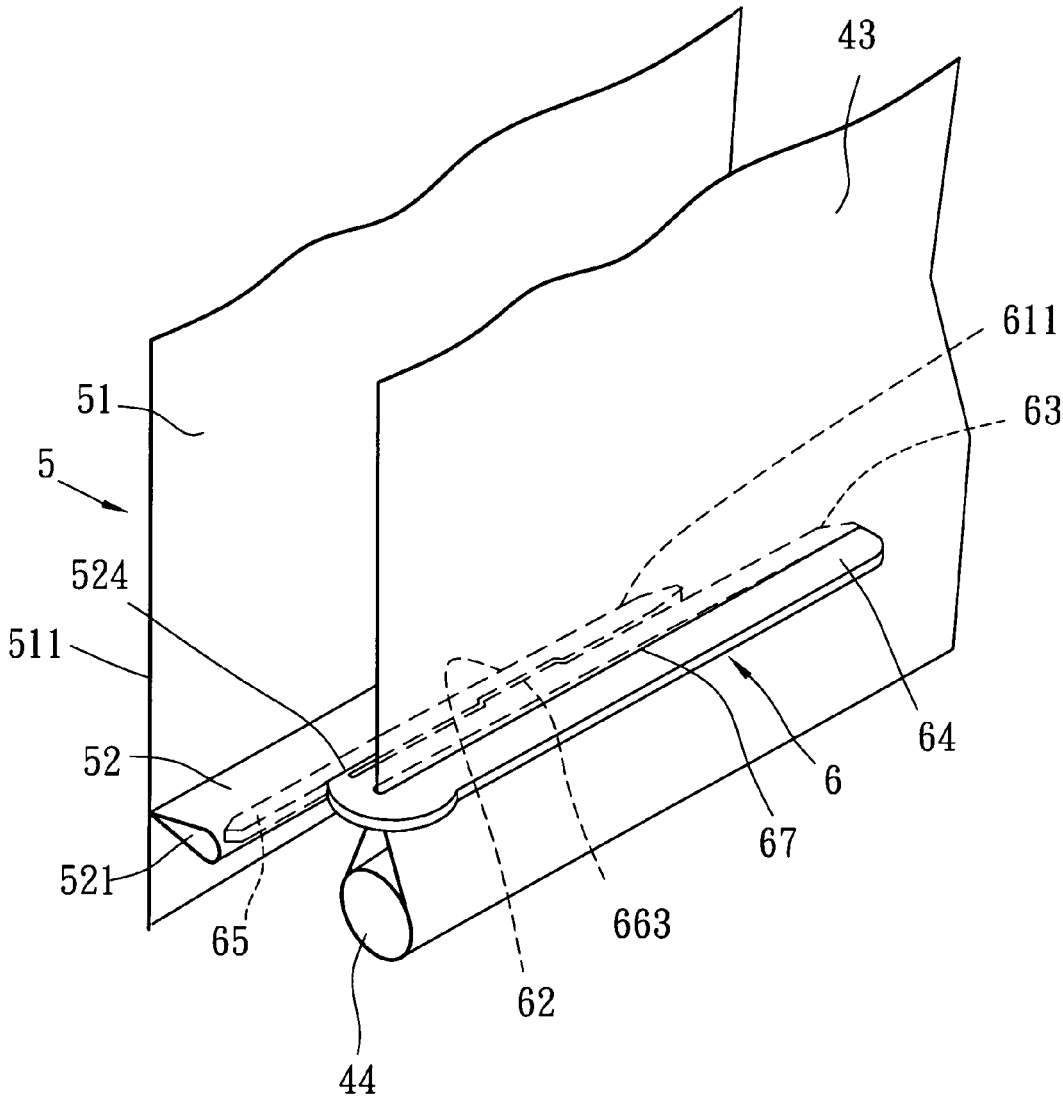
FIG. 7 is a fragmentary perspective view of the preferred embodiment.

Referring to FIGS. 4 to 6, the preferred embodiment of a window blind according to the present invention is shown to comprise a roll-up unit 4, a curtain unit 5, and a plurality of modular clip devices 6.

The roll-up unit includes a headrail 41, a winding roller 42, a roll-up piece 43, and a counterweight shaft 44. The headrail 41 is adapted be mounted at an upper edge of a window, and has a front wall surface. Left and right holders 45 are suspended from two ends of the headrail 41. The winding roller 42 has two ends journalled on the left and right holders 45 to be rollable about an axis in a longitudinal direction. The roll-up piece 43 has an upper end portion connected to the winding roller 42, and a lower end portion opposite to the upper end portion in a first direction transverse to the longitudinal direction. The roll-up piece 43 is disposed to be wound around the winding roller 42 to lift or lower the lower end portion. The counterweight shaft 44 is mounted on the lower end portion of the roll-up piece 43.

The curtain unit 5 includes a roman-type blind curtain 51, a plurality of elongate loop members 52, and a hooks-and-loops fastener 53. The blind curtain 51 has a top end portion releasably attached to the front wall surface of the headrail 41 by virtue of the hooks-and-loops fastener 53, such as Velcro, and is spaced apart from the roll-up piece 43 in a second direction transverse to both the first transverse direction and the longitudinal direction. The blind curtain 51 has a back major surface that confronts the roll-up piece 43, and that extends in the longitudinal direction to terminate at left and right lateral ends 511. The elongate loop members 52 are attached to the back major surface of the blind curtain 51. Each of the loop members 52 defines a lengthwise hole 521 that is oriented in the longitudinal direction, and has an anchoring head portion 522 which extends in the longitudinal direction to terminate at left and right edges 523 proximate to the left and right lateral ends 511 of the curtain 51, respectively. The anchoring head portion 522 has an access slot 524 in spatial communication with the lengthwise hole 521 and extending in the longitudinal direction, a marginal region 525 interposed between the left edge 523 and the access slot 524, and a gripped region 526 extending from the access slot 524 towards the right edge 523.

Each of the modular clip devices 6 includes a grip body 60 and a holding tongue 65. The grip body 62 has a major gripping wall 61 which extends in the longitudinal direction to terminate at leading and trailing sides 611,612, and which has loop-side and roll-up piece-side gaps 66,67 that respectively extend through the leading side 611 towards the trailing side 612 to form a middle gripping finger portion 63, and internal and external gripping finger portions 62,64 which flank the middle gripping finger portion 63. The holding tongue 65 is disposed to extend from the trailing side 612 of the internal gripping finger portion 62. In this embodiment, the holding tongue 65 is integrally formed with the grip body 60. The internal gripping finger portion 62 has a length larger than that of the holding tongue 65, and smaller than that of the middle and external gripping finger portions 63,64.

Moreover, the loop-side gap 66 defines a gap line, and has leading and trailing segments 661,662 opposite to each other along the gap line, and a middle segment 663 which is interposed between the leading and trailing segments 661,662, and which extends along an inside line offset from the gap line.

In assembly, the internal gripping finger portion 62 is placed in the lengthwise hole 521 by virtue of inserting therein the leading side 611 thereof through the access slot 524, and is shifted in the longitudinal direction, in cooperation with the middle gripping finger portion 63. Thus, the internal gripping finger portion 62 is in a linearly-displaceable snug engagement with the gripped region 526. The gripped region 526 is urged by the middle gripping finger portion 663 towards the internal gripping finger portion 62. Subsequently, the holding tongue 65 is brought to abut against the marginal region 525 so as to ensure immobility of the internal gripping finger portion 62 in the lengthwise hole 521. Finally, the roller-up piece 43 is snugly engaged in the roll-up piece-side gap 67 as a result of being forced to be inserted along the longitudinal direction.

When the roll-up piece 43 is wound up such that the counterweight shaft 44 is moved upwardly to push the middle and external gripping finger portions 63,64 upwardly. By virtue of the holding tongue 65 and the internal gripping finger portion 62 respectively abutting against the marginal and gripped regions 525,526, each clip device 6 can be forced evenly and thus no loosening of the clamping engagement between the roll-up piece 43 and the clip device 6 could possibly occur.

Furthermore, since the holding tongue 65 and the internal gripping finger portion 62 of each clip device 6 are linearly displaceable to be disengaged from the lengthwise hole 521 so as to detach the blind curtain 51 from the roll-up piece 43, and since the hooks-and-loops fastener 53 is disposed between the top end portion of the blind curtain 51 and the attached surface of the headrail 41, the blind curtain 51 can be conveniently removed for cleaning.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A window blind comprising: a winding roller mounted at an upper edge of a window and rollable about an axis in a longitudinal direction;

a roll-up piece which has an upper end portion connected to said winding roller, and a lower end portion opposite to said upper end portion in a first direction transverse to the longitudinal direction, and which is disposed to be wound around said winding roller to lift or lower said lower end portion;

a blind curtain which has a top end portion mounted at the upper edge of the window and spaced apart from said upper end portion in a second direction transverse to both the first transverse direction and the longitudinal direction, and a back major surface that confronts said roll-up piece, and that extends in the longitudinal direction to terminates at left and right lateral ends;

a plurality of elongate loop members attached to said back major surface, and each defining a lengthwise hole that is oriented in the longitudinal direction, each of said elongate loop members having an anchoring head portion which extends in the longitudinal direction to terminate at left and right edges proximate to said left and right lateral ends, respectively, said anchoring head portion having an access slot in spatial communication with said lengthwise hole and extending in the longitudinal direction, a marginal region interposed between said left edge and said access slot, and a gripped region extending from said access slot towards said right edge; and a plurality of modular clip devices, each including a grip body having a major or gripping wall which extends in the longitudinal direction to terminate at leading and trailing sides, and which has loop-side and roll-up piece-side gaps that respectively extend through said leading side towards said trailing side to form a middle gripping finger portion, and internal and external gripping finger portions which flank said middle gripping finger portion, said loop-side and roll-up piece-side gaps being dimensioned such that, when said internal gripping finger portion which is placed in said lengthwise hole by virtue of inserting therein said leading side thereof through said access slot, is shifted in the longitudinal direction, in cooperation with said middle gripping finger portion, said internal gripping finger portion is in a linearly-displaceable snug engagement with said gripped region, and such that said roller-up piece is linearly displaceable and snugly engageable in said roll-up piece-side gap; and a holding tongue which is disposed to extend from said trailing side of said internal gripping finger portion and which is brought to abut against said marginal region so as to ensure immobility of said internal gripping finger portion in said lengthwise hole.

2. The window blind according to claim 1, wherein said loop-side gap defines a gap line, and has leading and trailing segments opposite to each other along said gap line, and a middle segment which is interposed between said leading and trailing segments, and which extends along an inside line offset from said gap line such that said gripped region is urged by said middle gripping finger portion towards said internal gripping finger portion.

3. The window blind according to claim 2, wherein said holding tongue is integrally formed with said grip body.

4. The window blind according to claim 1, further comprising a headrail which is adapted be mounted at the upper edge of the window, and left and right holders which are suspended from two ends of said headrail, and which are configured to permit two ends of said winding roller to be journalled thereon, said headrail having a front wall surface to permit said top end portion of said curtain to be releasably attached thereto.

5. The window blind according to claim 4, further comprising a hooks-and-loops fastener disposed between said front wall surface and said top end portion.

* * * * *